US006513569B1

(12) United States Patent
Li et al.

(10) Patent No.: US 6,513,569 B1
(45) Date of Patent: Feb. 4, 2003

(54) VACUUM VALVE FOR DIE CASTING MACHINE

(76) Inventors: Chun Hsien Li, No. 12, Lane 81, San Chun St., Shulin, Taipei Hsien (TW); Yun Wang Ku, No. 12, Lane 81, San Chun St., Shulin, Taipei Hsien (TW)

( * ) Notice: Subject to any disclaimer, the term of this patent is extended or adjusted under 35 U.S.C. 154(b) by 0 days.

(21) Appl. No.: 09/985,198

(22) Filed: Nov. 2, 2001

(51) Int. Cl.[7] ..... B22D 17/14; B22D 17/20
(52) U.S. Cl. ..... 164/305; 164/253
(58) Field of Search ..... 164/305, 253, 164/254, 410

(56) References Cited

U.S. PATENT DOCUMENTS 5,538,069 A * 7/1996 Freeman ..... 164/253
5,540,272 A * 7/1996 Freeman ..... 164/253
6,082,438 A * 7/2000 Zielinski et al. ..... 164/457

* cited by examiner

*Primary Examiner*—Tom Dunn
*Assistant Examiner*—Ing-Hour Lin
(74) *Attorney, Agent, or Firm*—Rosenberg, Klein & Lee

(57) ABSTRACT

A vacuum valve for die casing machine comprises a valve seat, a bottom die and a top die and a wavy lead-in runner between the bottom and top die. The bottom die has a vent hole and the top die has a feed-in inlet. The valve seat has an accommodating tank enclosing two gears, each gear engaged with one tooth rack. An induction rod is arranged on the tooth rack near the feed-in inlet and passing through an induction hole on the bottom die. A control rod is arranged on the tooth rack near the vent hole and passes through a valve hole on the bottom die. The control rod has a plurality of axial slots on one end thereof. The axial slots are initially exposed out of the valve hole and moved with the control rod to indent into the valve hole to seal the valve hole.

3 Claims, 6 Drawing Sheets

VACUUM VALVE FOR DIE CASTING MACHINE

FIELD OF THE INVENTION

The present invention relates to a vacuum valve for die casing machine, especially to a vacuum valve for die casing machine, which has an improved structure to prevent the congestion problem of valve hole.

BACKGROUND OF THE INVENTION

FIG. 1 shows a prior art vacuum valve for die casing machine, which comprises a vacuum valve seat 1 and a movable stage 2. The vacuum valve seat 1 comprises an induction rod 11 and a control rod 12. The induction rod 11 and the control rod 12 are arranged in the vacuum valve seat 1 and have tooth racks 13 and 14 respectively and oppositely. A pair of gears 15 and 16 is provided between the tooth racks 13 and 14 and pivotally arranged within a tank 10 in the vacuum valve seat 1.

The induction rod 11 and the control rod 12 have synchronous movement due to the linkage of the gears 15 and 16. The vacuum valve is connected to a molding die (not shown) and may inhale the molten metal. The vacuum valve is functioned to drain air out of the molding die to facilitate the molten metal to flow into the air-exhausted molding die. Otherwise, remaining air in the molding die may cause defect therein.

Therefore, the vacuum valve is functioned to both suck air from the molding die and speed the molten metal to flow into the air-exhausted molding die. The induction rod 11 and the control rod 12 are linked to each other and simultaneously seal an induction hole 17 and a valve hole 18 in the vacuum valve seat I when the molding die is full of molten metal, thus sealing a ventilating path 41 connected to a ventilator 4. At this time, the molten metal is flown from the molding die to the vacuum valve and fill a reserved space 19 in the vacuum valve seat 1.

As shown in this figure, the valve hole 18 is provided with respect to the control rod 12, wherein the valve hole 18 is a tunnel-shaped hole and the control rod 12 has a conic distal end 121. When foreign object is present in the valve hole 18, it is hard for the conic distal end 121 to seal the valve hole 18. Therefore, the vacuum valve is still ventilated by the ventilator 4 and the ventilator 4 even may inhale the molten metal. The ventilator 4 has the risk of being deteriorated by the foreign object and post-cleaning of the ventilator 4 is cumbersome.

SUMMARY OF THE INVENTION

It is the object of the present invention to provide a vacuum valve for die casing machine, which has an improved structure to prevent the congestion problem of valve hole. More particularly, the vacuum valve has a control rod with plurality of axial slots on one end thereof. The axial slots can advantageously remove foreign object from the valve.

To achieve above object, the present invention provides a vacuum valve for die casing machine comprising a valve seat, a bottom die and a top die. A wavy lead-in runner is provided between the bottom die and the top die. The bottom die has a vent hole and the top die has a feed-in inlet. The valve seat has a plurality of positioning pins engaged with corresponding positioning holes on the bottom die. The valve seat has an accommodating tank enclosing a pair of gears and each gear engaged with one tooth rack. An induction rod is arranged on the tooth rack near the feed-in inlet and passing through an induction hole on the bottom die. A control rod is arranged on the tooth rack near the vent hole and passes through a valve hole on the bottom die. The control rod has a plurality of axial slots on one end thereof. The axial slots are initially exposed out of the valve hole and moved with the control rod to indent into the valve hole to seal the valve hole.

The various objects and advantages of the present invention will be more readily understood from the following detailed description when read in conjunction with the appended drawing, in which:

DETAILED DESCRIPTION OF THE INVENTION

Figure 1:
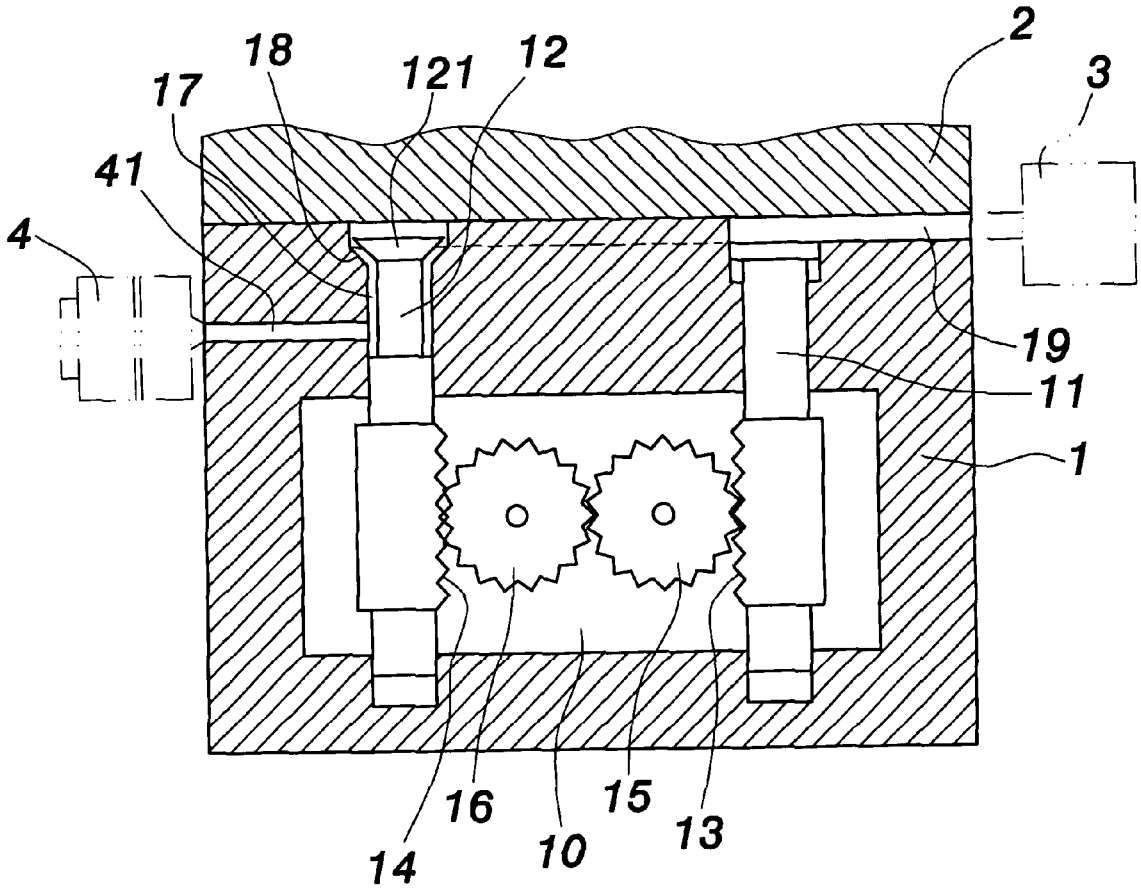
FIG. 1 PRIOR ART
FIG. 1 shows a sectional view of prior art vacuum valve for die casing machine.
Figure 2:
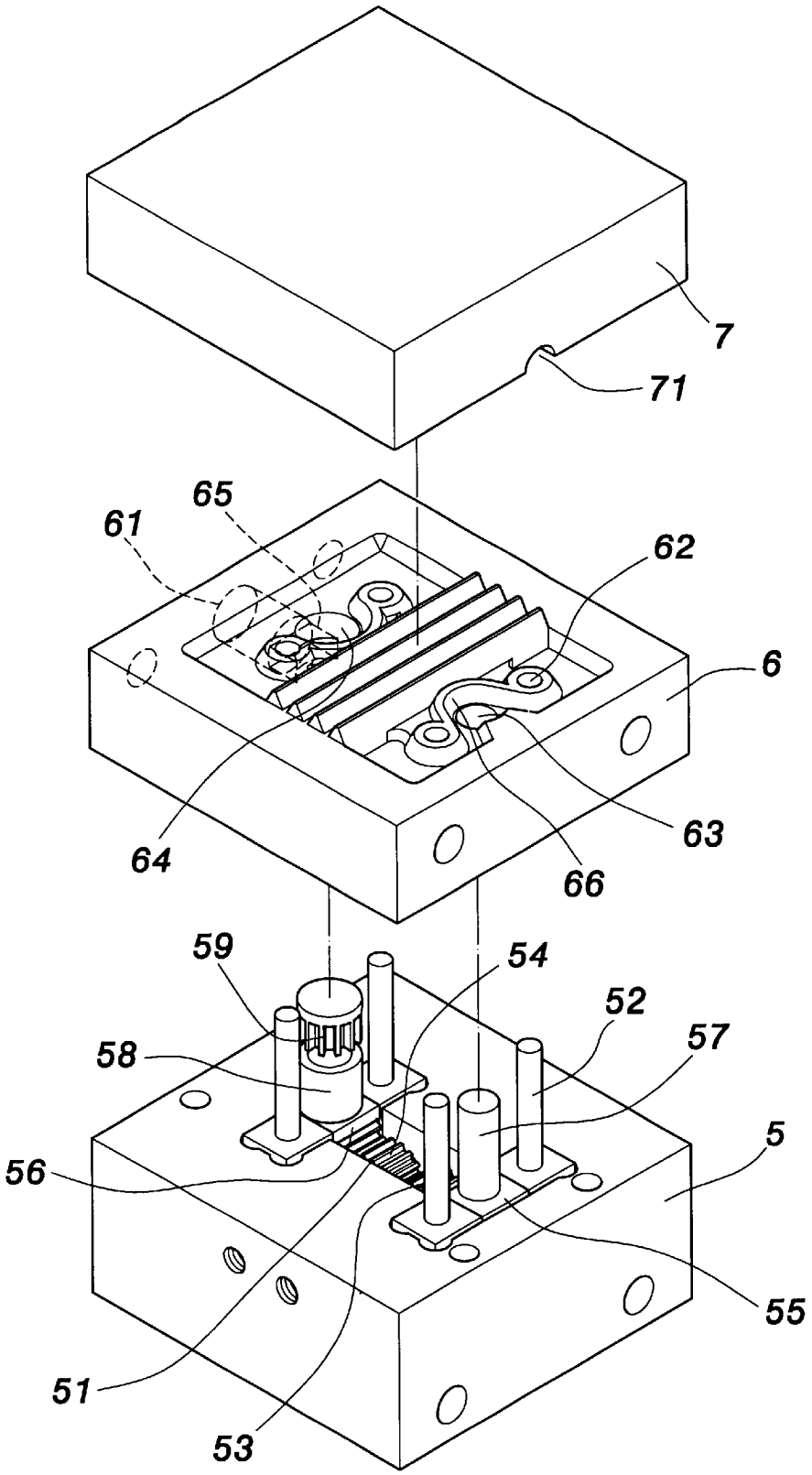
FIG. 2 shows an exploded view of the vacuum valve for die casing machine according to the present invention.
Figure 3:
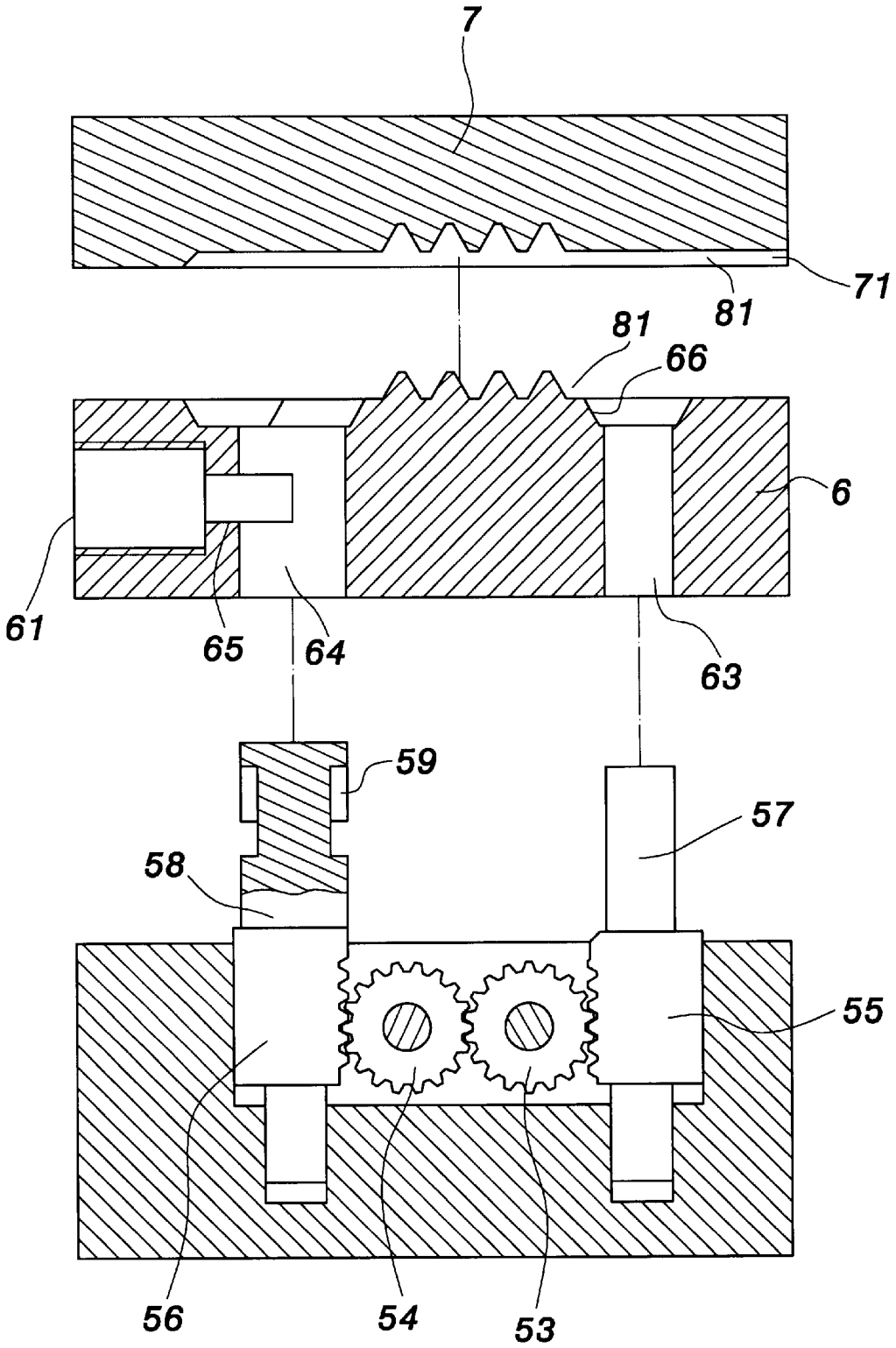
FIG. 3 shows a sectional exploded view of the vacuum valve for die casing machine according to the present invention.

With reference to FIGS. 2 to 6, the present invention is intended to provide an improved vacuum valve for die casing machine. The vacuum valve comprises a valve seat 5, a bottom die 6 and a top die 7. A wavy lead-in runner 81 is provided between the bottom die 6 and the top die 7 and connected to a molding die 8. The lead-in runner 81 is made of wavy shape to retard the flowing speed of the molten metal. Moreover, the lead-in runner 81 can be made of other shape instead of wavy shape. The top die 7 has a feed-in inlet 71 and the bottom die 6 has a vent hole 61 connected to a ventilator 9. The ventilator 9, for example, can be a vacuum pump. A ventilating path 91 is provided out of the vent hole 61 and a vent passage 65 is provided internal to the vent hole 61. Moreover, the bottom die 6 has a plurality of positioning holes 62 engaged to corresponding positioning pins 52 on the valve seat 5.

The valve seat 5 has an accommodating tank 51 and a pair of gears 53 and 54 is pivotally arranged in the accommodating tank 51. The gears 53 and 54 are engaged to two tooth racks 55 and 56, respectively. The tooth rack 55 near the feed-in inlet 71 is connected to an induction rod 57 and the induction rod 57 passes through an induction hole 63 on the bottom die 6. The tooth rack 56 near the vent hole 61 is connected to a control rod 58 and the control rod 58 passes through a valve hole 64 on the bottom die 6. The control rod 58 has a plurality of axial slots 59 near a distal end thereof and the axial slots 59 are placed out of the valve hole 64. The control rod 58 is moved with the induction rod 57 to seal the valve hole 64 and the axial slots 59 can prevent the control rod 58 from being influenced by foreign object present in the valve hole 64. Therefore, the control rod 58 can be smoothly moved. The bottom die 6 has a semi-circular guiding flange 66 at rear side of the induction hole 63 to guide the molten metal into the induction hole 63.

Figure 4:
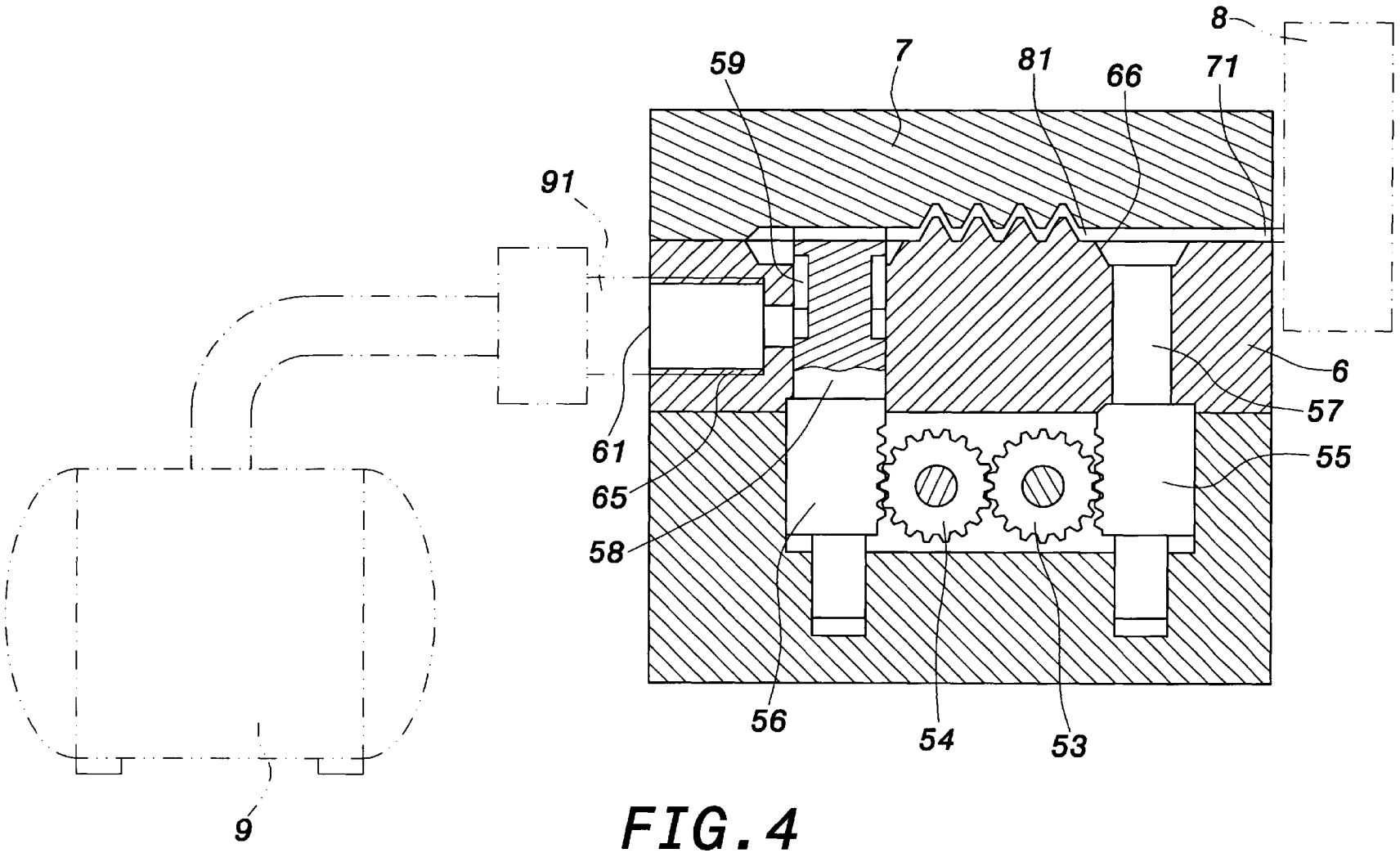
FIG. 4 shows a sectional view of the vacuum valve for die casing machine according to the present invention.
Figure 5:
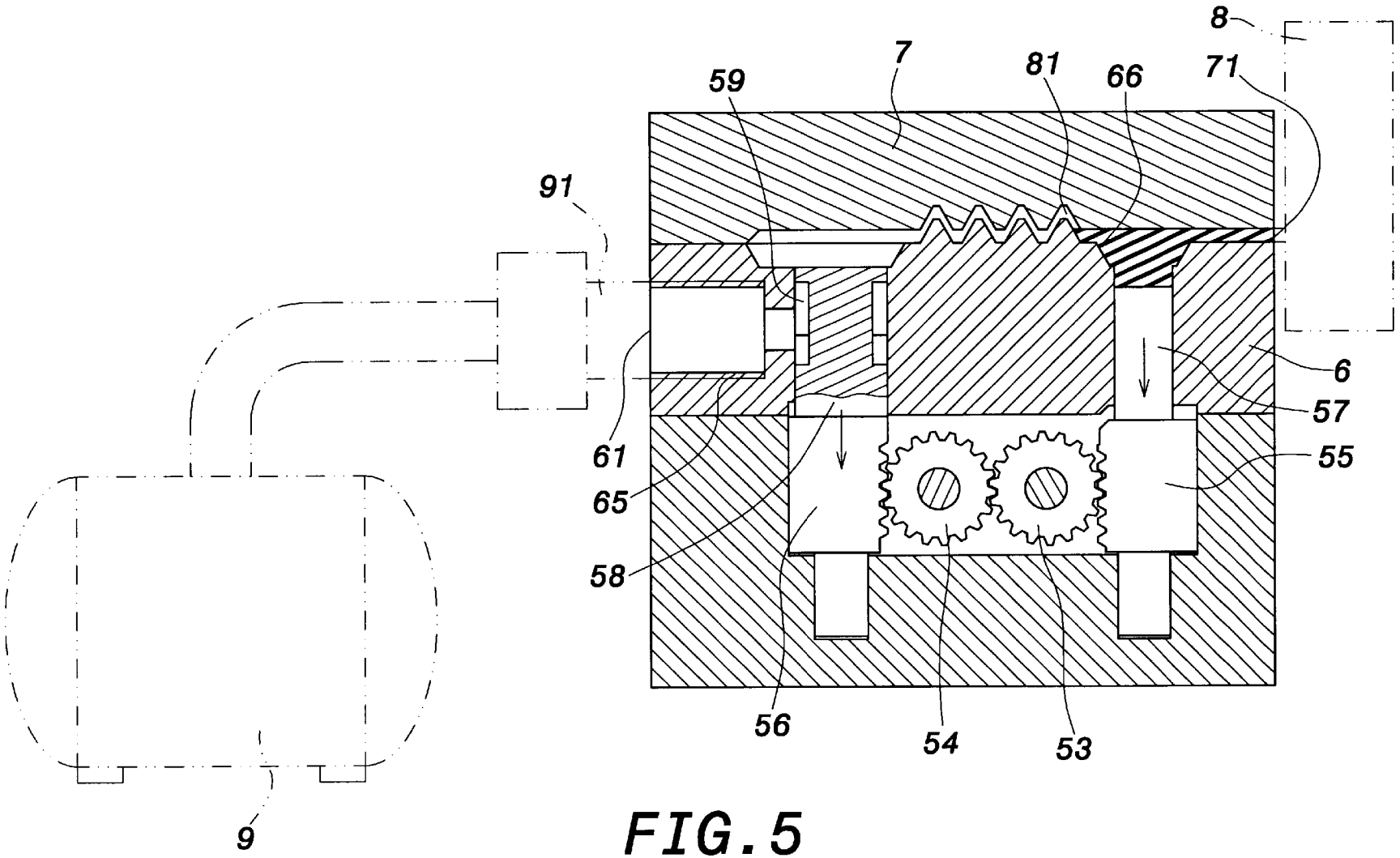
FIG. 5 shows a sectional view of the vacuum valve for die casing machine according to the present invention before the valve is sealed.
Figure 6:
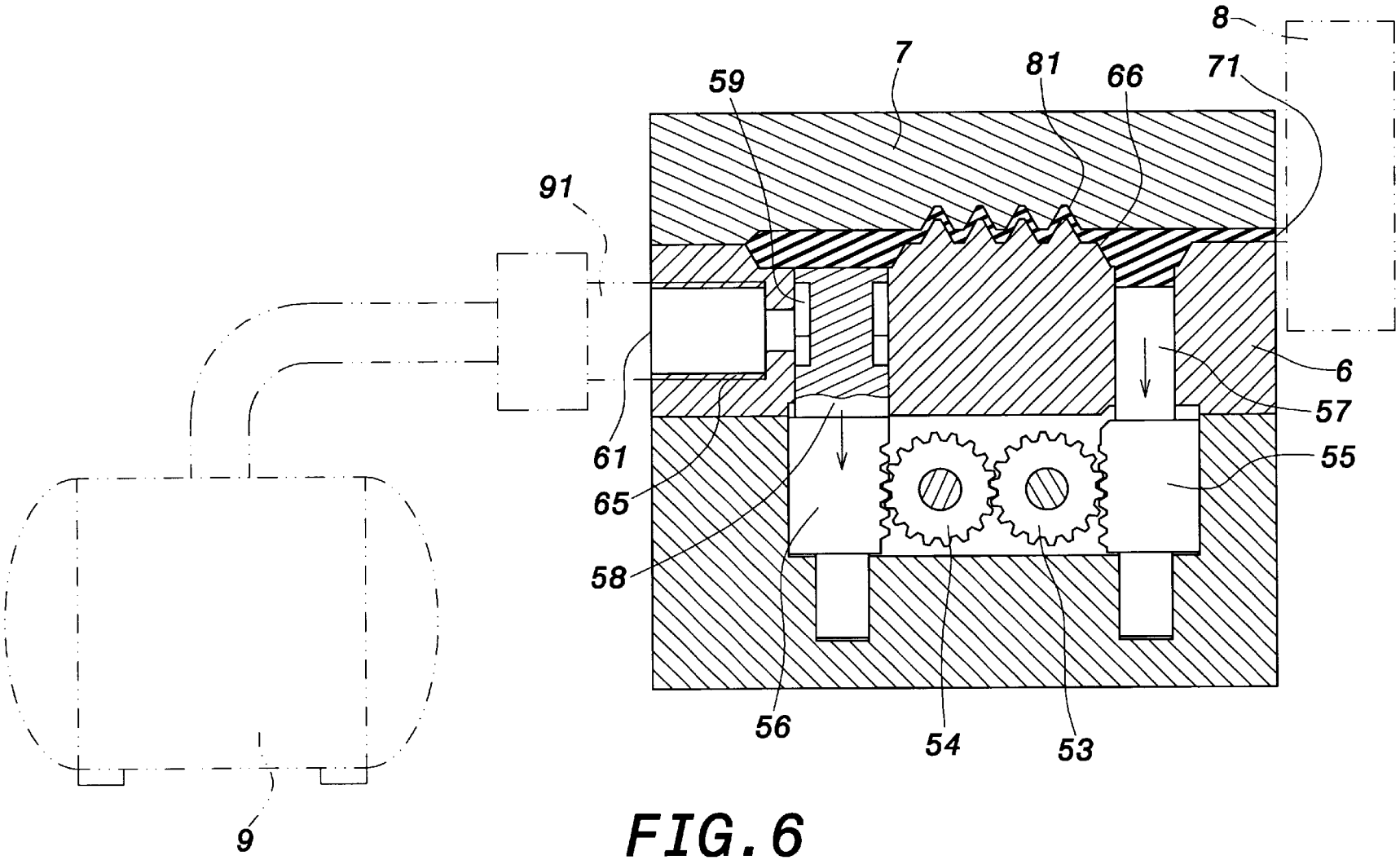
FIG. 6 shows a sectional view of the vacuum valve for die casing machine according to the present invention after the valve is sealed.

The present invention utilizes straight control rod in junction with straight valve hole and the axial slots formed on the straight control rod are used as flowing path of air to facilitate air ventilation. As shown in FIG. 4, when the molten metal flows to a position near the induction rod 57, the molten metal pushes the guiding flange 66 to move the induction rod 57. As shown in FIG. 5, the control rod 58 has circular cross section to tightly seal the valve hole 64, thus blocking ventilation. As shown in FIG. 6, the molten metal can be prevented from flowing to the ventilator 9. Moreover, the axial slots formed on the distal end of the straight control rod can move away foreign object near the opening of the valve hole 64. Therefore, the blocking problem in prior art can be solved.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

We claim:

1. A vacuum valve for die casing machine, comprising a valve seat having a plurality of positioning pins and an accommodating tank, and pair of gears pivotally arranged in the accommodating tank;

a bottom die having a vent hole connected to the valve seat and a plurality of positioning holes engaged with the positioning pins, the bottom die further having an induction hole and a valve hole;

a top die having a feed-in inlet connected to the bottom die and a lead-in runner between the bottom die and the top die;

an induction rod arranged on a tooth rack near the feed-in inlet and passing through the induction hole;

a control rod arranged on a tooth rack near the vent hole and passing through the valve hole, the control rod having a plurality of axial slots near one distal end thereof and initially exposed out of the valve hole, the axial slots being moved with the control rod to indent into the valve hole to seal the valve hole, wherein each of the gears are engaged with a respective tooth rack.

2. The vacuum valve for die casing machine as in claim 1, wherein the valve hole is a straight hole.

3. The vacuum valve for die casing machine as in claim 1, wherein the control rod is a straight rod.

* * * * *